US008619506B2

(12) United States Patent
Hiranuma

(10) Patent No.: US 8,619,506 B2
(45) **Date of Patent: *Dec. 31, 2013**

(54) TIMEPIECE

(75) Inventor: Haruki Hiranuma, Chiba (JP)

(73) Assignee: Seiko Instruments Inc. (JP)

( * ) Notice: Subject to any disclaimer, the term of this patent is extended or adjusted under 35 U.S.C. 154(b) by 15 days.

This patent is subject to a terminal disclaimer.

(21) Appl. No.: 13/414,782

(22) Filed: Mar. 8, 2012

(65) Prior Publication Data

US 2012/0236693 A1 Sep. 20, 2012

(30) Foreign Application Priority Data

Mar. 10, 2011 (JP) ..... 2011-053462

(51) Int. Cl.
*G04B 1/00* (2006.01)

(52) U.S. Cl.
USPC ..... 368/205

(58) Field of Classification Search
USPC ..... 368/205, 223, 228, 232, 236, 239, 243, 368/287, 294, 295, 297, 299, 300
See application file for complete search history.

(56) References Cited

U.S. PATENT DOCUMENTS 4,207,735 A * 6/1980 Ishigaki et al. ..... 368/300
6,456,569 B1 * 9/2002 Stauffer ..... 368/236
6,575,619 B1 * 6/2003 Stauffer ..... 368/299

FOREIGN PATENT DOCUMENTS

JP 2001 194470 7/2001

* cited by examiner

*Primary Examiner* — Edwin A. Leon
(74) *Attorney, Agent, or Firm* — Adams & Wilks

(57) ABSTRACT

A timepiece includes a movement contained in a timepiece exterior assembly. A panel is fixed onto the movement. Upward engagement convex portions having pressing portions in upper portions thereof are formed in a plurality of locations of the ring member, and a ring member is fixed to the peripheral portion of the movement. A display plate has a plurality of reception portions in a peripheral portion thereof with which the pressing portion comes into contact from above. The reception portions are vertically interposed by an upper surface of the ring member and the pressing portions, the display plate is attached to the ring member, and the panel is covered with the display plate.

9 Claims, 12 Drawing Sheets

TIMEPIECE

BACKGROUND OF THE INVENTION

1. Field of the Invention

The present invention relates to a timepiece such as a wristwatch in which a panel for electricity generation or light emission is provided in a module displaying a time or the like and the panel is covered with a display plate. Particularly, the present invention relates to a timepiece in which an attachment configuration of the display plate is improved.

2. Description of the Related Art

A timepiece is known as a related art in which a panel including a solar cell or an electroluminescence and a light-transmissive display plate covering the same are disposed on the module (for example, see Japanese Patent No. 4398555 (Patent Document 1)).

In the related art, an auxiliary ring formed of a resin molding product has a pair of cylindrical projection portions in a plurality of locations on an upper surface of an outer peripheral portion thereof, respectively, and has a projection on a lower surface thereof. The projections of the auxiliary ring are engaged with the module, and the auxiliary ring is fixed to the module. With this, the display plate is formed in a thin plate shape by a synthetic resin such as a transparent acrylic resin or a polycarbonate resin, and has a plurality of notches in a peripheral portion thereof. By engaging the notches with the cylindrical projection portions of the module, the display plate is fixed to the auxiliary ring.

Specifically, the pair of cylindrical projection portions has a gap therebetween and is formed so as to be elastically deformable toward the gap. The notches of the display plate elastically deform a pair of cylindrical projection portions placed inside thereof in a direction approaching each other and are engaged with them. As a result, it is possible to fix the display plate in the state in which a lateral deviation or rotation is prevented.

In a timepiece according to the related art, a diameter of the cylindrical projection portion is not changed from a root thereof to a tip thereof, and the holding of the display plate to the auxiliary ring only depends on an engagement force that acts from the cylindrical projection portion to an edge of the notch in a horizontal direction (a lateral direction).

By such engagement force, warping based on the plurality of notches is easily generated in the display plate having relatively low strength, whereby a distortion is generated in the display plate. Since an occurrence of the distortion degrades the quality of the timepiece, an improvement thereof is desired.

Furthermore, an assembly including an auxiliary ring and a display plate attached thereto as mentioned above is moved toward the incorporation until being incorporated to a timepiece exterior assembly after integration of the assembly, and thus, the assembly receives the vibration or the like at that time. For that reason, in the configuration of the related art mentioned above in which the display plate is held only by the horizontal engagement force with the cylindrical projection portion, the display plate is moved upward and floats owing to the vibration or the like, such a situation further progresses and the display plate may deviate.

As mentioned above, in the timepiece of the related art, there is a problem in that the display plate is liable to be attached in a distorted manner, and, until the auxiliary ring and the display plate attached thereto are incorporated to the timepiece exterior assembly, the display plate floats or deviates with respect to the ring member.

SUMMARY OF THE INVENTION

In order to solve the problem, according to the present invention, there is provided a timepiece which includes a timepiece exterior assembly; a module that is built in the timepiece exterior assembly; a panel that is fixed onto the module; a ring member of a ring shape when viewed from a plane that is fixed to a peripheral portion of the module, upward engagement convex portions being formed in a plurality of locations of the member, and the engagement convex portions having pressing portions; and a display plate that is disposed to cover the panel and has a plurality of reception portions in a peripheral portion of the display plate with which the pressing portion comes into contact from above, the reception portions being vertically interposed by an upper surface of the ring member and the pressing portions and being attached to the ring member.

In the present invention, when the module is implemented as an analog type timepiece, the module indicates a movement which drives a plurality of time display needles, and when being implemented as a digital type timepiece, the module indicates an electronic circuit which drives a display showing the time or the like. In the present embodiment, the panel indicates a solar battery panel, a light emitting panel or the like.

In the present invention, when being implemented as an analog type timepiece, the display plate indicates a light transmissive hour plate, and when being implanted as a digital type timepiece, the display plate has a window facing a desired part of a display indicating the time or the like, and a part other than the window indicates a cover plate (in addition, the plate is known as a clearance plate) that covers the display.

In the present invention, it is desirable that the pressing portions of the engagement convex portions come into contact with the reception portions, which partition a part of a pressing portion accommodation groove formed in the display plate described later, from above. However, apart from this, it is also possible to use a part of the peripheral portion upper surface of the display plate as the reception portion and bring the pressing portion into contact with the reception portion from above.

In the present invention, as described below, it is desirable that the display plate be attached so as not to be moved in an upward direction and a circumferential direction thereof only by the contact between the pressing portion and the reception portion. However, the contact between the pressing portion and the reception portion takes charge of floating stop means for holding the display plate so as not to be moved upward, and apart from this, a rotation stop means for holding the display plate so as not to be moved in the circumferential direction may be provided.

Thus, for example, it is also possible to provide the rotation stop means for bringing a side surface of the elastically deformed engagement convex portion into contact with an edge of the pressing portion accommodation groove formed in the peripheral portion of the display plate and holding the display plate so as not to be moved in the circumferential direction, and provide the floating stop means for pressing the reception portion having a slope surface from above, a step or the like forming a part of a display plate upper surface around the pressing portion accommodation groove or the pressing portion accommodation groove by the pressing portion formed in an upper portion of the engagement convex portion and holding the display plate so as not to be moved upward. Furthermore, it is also possible to provide and perform the floating stop means for bringing the pressing portion of the engagement convex portion into contact with the reception portion provided in a peripheral portion position separated from the rotation stop means in the circumferential direction of the display plate from above, and holding the display plate so as not to be moved upward.

In the present invention, the engagement convex portion of the ring member has the pressing portion, the pressing portion comes into contact with the reception portion of the display plate from above, and the display plate is vertically interposed by the ring member and the engagement convex portion. For this reason, it is possible to suppress that the display plate is moved to the upper side with respect to the ring member, and floats or deviates owing to the vibration or the like to be applied until the ring member with the display plate attached thereto is inserted into the timepiece exterior assembly, by the pressing portion of the engagement convex portion with the peripheral portion of the display plate vertically interposed between the pressing portion and the upper surface of the ring member.

Furthermore, in the present invention, since the pressing portion of the engagement convex portion comes into contact with the reception portion of the display plate from above to perform the floating stop of the display plate, it is difficult to generate an excessive stress around the pressing portion accommodation groove of the display plate by the engagement convex portion. Thus, it is possible to suppress the display plate being attached to the ring member in an undulated and distorted manner starting from the pressing portion accommodation groove.

In the preferred aspect of the present invention, pressing portion accommodation grooves opened to the peripheral surface of the display plate are formed in a plurality of locations of the peripheral portion of the display plate, the reception portions are provided so as to partition a part of the pressing portion accommodation grooves, and the pressing portions are housed in the pressing portion accommodation grooves. In the preferred aspect, the reception portion may be a step and may be a reception portion that has an upper surface including a slope surface.

The invention of the preferred aspect further has an advantage that it is possible to position the display plate in the circumferential direction of the ring member by the pressing portion accommodation groove of the display portion peripheral portion and the pressing portion of the engagement convex portion housed therein.

In the preferred aspect of the present invention, the reception portions have reception slope surfaces that partition a part of the pressing portion accommodation groove, the reception slope surfaces face a width direction of the pressing portion accommodation grooves and are widely formed as the pressing portion accommodation grooves face upward, and the pressing portions have pressing slope surfaces coming into contact with the reception slope surfaces from above, respectively, and are widely formed as the pressing portions face upward.

In the invention of the preferred aspect, in a state where the pressing portion of the engagement convex portion having the pair of pressing slope surfaces coming into contact with the reception slope surfaces enters downward in a wedge shape between a pair of reception portions having the reception slope surfaces facing the width direction of the pressing portion accommodation groove, the pair of reception portions is vertically interposed between the pressing portion of the engagement convex portion and the upper surface of the ring member. For this reason, it is possible to hold the display plate so as not to be moved upward. In addition to this, the engagement convex portion can hold the display plate so as not to be moved in the circumferential direction by using the pressing portion as a stopper. Thus, the invention of the preferred aspect has a further advantage that the engagement convex portion and the reception portion can take charge of the floating stop and the rotation stop of the display plate.

In the preferred aspect of the present invention, the timepiece further includes mutually opposite groove side surfaces of the pressing portion accommodation grooves, the reception portions have reception slope surfaces that partition a part of the pressing portion accommodation grooves, the reception slope surfaces are formed on bottom surfaces of the pressing portion accommodation grooves tilted down as the reception slope surfaces face open ends of the pressing portion accommodation grooves, the pressing portions have slope sides surface tilted so as to approach each other as going to tip sides thereof and are formed in a tapered shape, the tip portions of the pressing portions come into contact with the reception slope surfaces from above, and the slope side surfaces come into contact with corners formed by the groove side surfaces and the peripheral surface of the display plate, respectively.

In the preferred invention, the pressing portion of the engagement convex portion housed in the pressing portion accommodation groove is configured so that the tip portion thereof comes into contact with the reception slope portion of the reception portion from above and the display plate is vertically interposed between the pressing portion and the upper surface of the ring member. As a result, it is possible to hold the display plate so as not to be moved upward. In addition to this, the slope side surfaces of both sides of the pressing portion formed in the tapered shape in the width direction come into contact with the corners formed by the groove side surface of the pressing portion accommodation groove and peripheral surface of the display plate, respectively. As a result, the engagement convex portion can hold display plate so as not to be moved in the circumferential direction by using the pressing portion as a stopper. Thus, in the invention of the preferred aspect, the engagement convex portion and the reception portion can take charge of the floating stop and the rotation stop of the display plate.

In the preferred aspect of the present invention, the engagement convex portion can be elastically deformed in a radial direction of the ring member and the display plate based on a root thereof as a fulcrum.

In the invention of the preferred aspect, upon attaching the display plate to the ring member, the engagement convex portion can be elastically deformed based on the root thereof as a fulcrum in a direction in which the pressing portion deviates from the pressing portion accommodation groove. As a result, there is a further advantage that an attachment workability of the display plate can be further improved.

In the preferred aspect of the present invention, a contact projection coming into contact with an inner peripheral surface of a body included in the timepiece exterior assembly is integrally provided in an upper portion of the engagement convex portion.

In the invention of the preferred aspect, since the contact projection of the display plate comes into contact with the inner peripheral surface of the body in the state where the assembly having the module, the display plate, the ring member or the like is incorporated into the timepiece exterior assembly, the pressing portion of the engagement convex portion is pressed toward the inner side of the pressing portion accommodation groove. As a result, there is a further advantage that the contact between the pressing portion and the reception portion of the display plate is strengthened and it is possible to improve the holding capacity of the assembly to the timepiece exterior assembly.

In the preferred aspect of the present invention, an annular clearance is further included which comes into contact with upper surface of the peripheral portion of the display plate and covers the peripheral portion, and the height of the upper end of the pressing portion is equal to or less than the upper surface of the display plate. In the invention of the preferred aspect, the clearance may be formed integrally with the body included in the timepiece exterior assembly, or may be a component that is separated from the body and is disposed adjacent to the inner surface of the body.

In the invention of the preferred aspect, since the pressing portion is accommodated in the pressing portion accommodation groove so as not to be protruded from the upper surface of the display plate, a gap caused by the pressing portion is not formed between the clearance and the peripheral portion upper surface of the display plate, and there is a further advantage that it is possible to bring the clearance into contact with the peripheral portion upper surface of the display plate.

In the preferred aspect of the present invention, the panel is a solar battery panel that generates electricity by a photoelectric conversion.

The invention of the preferred aspect has a further advantage in that the electric power to be supplied to the module or the like, for example, driven by the electric power can be generated by the solar battery panel that receives light transmitted through the display plate.

In a preferred aspect of the present invention, the panel is a light emitting panel that emits light in an electrically conducted state.

The invention of the preferred aspect has a further advantage in that the light emitting panel emits light by the electric conduction thereto and a backlight illumination to the display plate is possible, and thus, visibility of the display of the time or the like can be further improved.

According to the timepiece of the present invention, it is possible to expect an effect which can suppress the distorted attachment of the display plate and can suppress that the display plate floats or deviates to the ring member until the display plate attached to the ring member is incorporated into the timepiece exterior assembly.

DETAILED DESCRIPTION OF THE PREFERRED EMBODIMENTS

Hereinafter, a first embodiment of the present invention will be described with reference to FIGS. 1 to 7 in detail.

Figure 1:
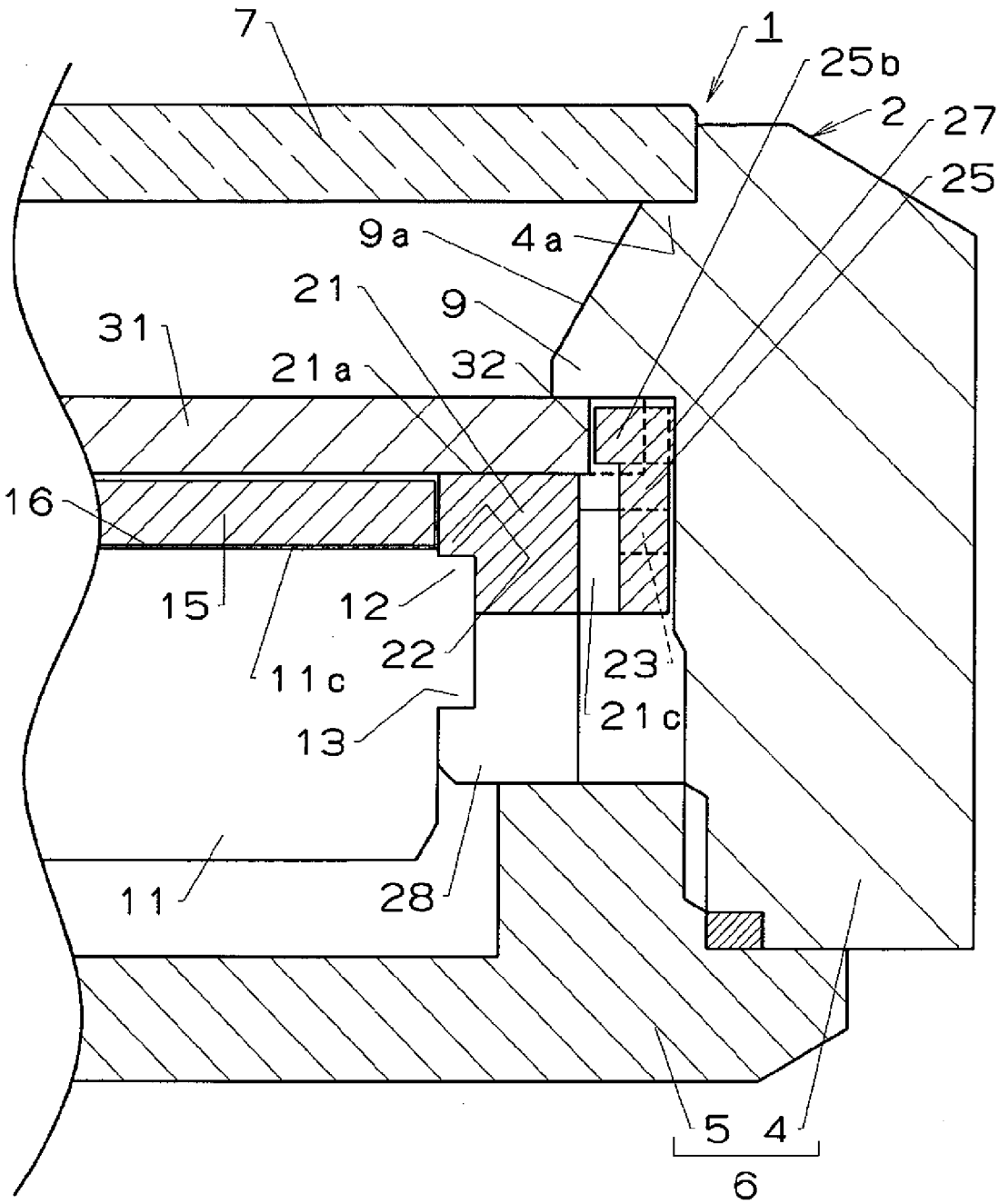
FIG. 1 is a cross-sectional view that shows a part of a wristwatch according to a first embodiment of the present invention.

Reference numeral 1 in FIG. 1 shows a timepiece, for example, a portable timepiece, specifically, a wristwatch. The wristwatch 1 includes a timepiece exterior assembly 2, a clearance 9, a module, for example, a movement 11, a panel, for example, a solar battery panel 15, a ring member 21, and a display plate, for example, an hour plate 31.

The timepiece exterior assembly 2 includes an exterior member 6 made of a metal or a synthetic resin having a body 4 and a back cover 5, and a cover glass 7. The back cover 5 is screwed and connected to the body 4. The cover glass 7 is mounted inside a glass support portion 4*a* formed in the body 4 in a liquid-tight manner.

The clearance 9 is provided between the peripheral portion thereof and a peripheral portion of the cover glass 7 so as to cover an upper surface of the peripheral portion of the hour plate 31. The clearance 9 shown in FIG. 1 is integrally formed on an upper portion inner periphery of the body 4, but may be a ring-shaped member that is formed separately from the body 4. The clearance 9 has an inner peripheral slope surface 9*a* formed so that an opening diameter thereof is shorter on the lower side, and the inner peripheral slope surface 9*a* faces an inner peripheral back surface of the glass cover 7.

The movement 11 is driven by the electric power generated by a solar battery panel 15 described later, and includes a secondary battery for accumulating the electric power, a capacitor or the like (not shown). The movement 11 has a circular shape when viewed from a plane. The movement 11 is incorporated into the timepiece exterior assembly 2 together with a ring member 21, an hour plate 31 or the like described later.

The movement 11 has an engagement portion 12. The engagement portion 12 is provided at an upper surface 11*a* side in a peripheral portion of the movement 11, and, for example, is formed in an upper end part of a ring-shaped convex portion continued in a circumferential direction of the movement 11. As shown in FIG. 1, the engagement portion 12 is slightly retreated in the back side (the lower side) of the movement 11 with respect to the upper surface 11*a* of the movement 11.

The solar battery panel 15 is a panel in which a solar cell (not shown) as an electricity generation element generating electricity by the photoelectric conversion is mounted on a substrate (not shown). The solar cell may be a crystal system or an amorphous system. The solar battery panel 15 has a diameter slightly smaller than that of the movement 11, and is fixed to the upper surface 11*a* of the movement 11 by the use of a bonding member 16. As the bonding member 16, it is possible to very suitably use a double-sided adhesive tape in which both sides thereof have adhesiveness.

The ring member 21 is formed of a synthetic resin, for example, an integrated molded product of Duracon. The ring member 21 forms a ring shape when viewed from a plane, an inner diameter thereof is slightly greater than the diameter of the solar battery panel 15, and an outer diameter thereof is greater than the diameter of the movement 11. The ring member 21 has engagement grooves 22 that are opened to the inner surface and the back surface (a lower surface) thereof. The engagement grooves 22 are continuously formed in the circumferential direction ring member 21 in a ring shape.

Furthermore, the ring member 21 has a shoulder portion 21*b* (see FIG. 5) extending down from the upper surface 21*a*. The shoulder 21*b* is continuously formed in the circumferential direction in a ring shape. The ring member 21 has hook portions 28 (only one is shown in FIG. 1) in a plurality of locations of the back surface, and has hollows 23 in the shoulder portion 21*b* and engagement convex portions 25 of the same number as those in a plurality of locations.

Figure 2:
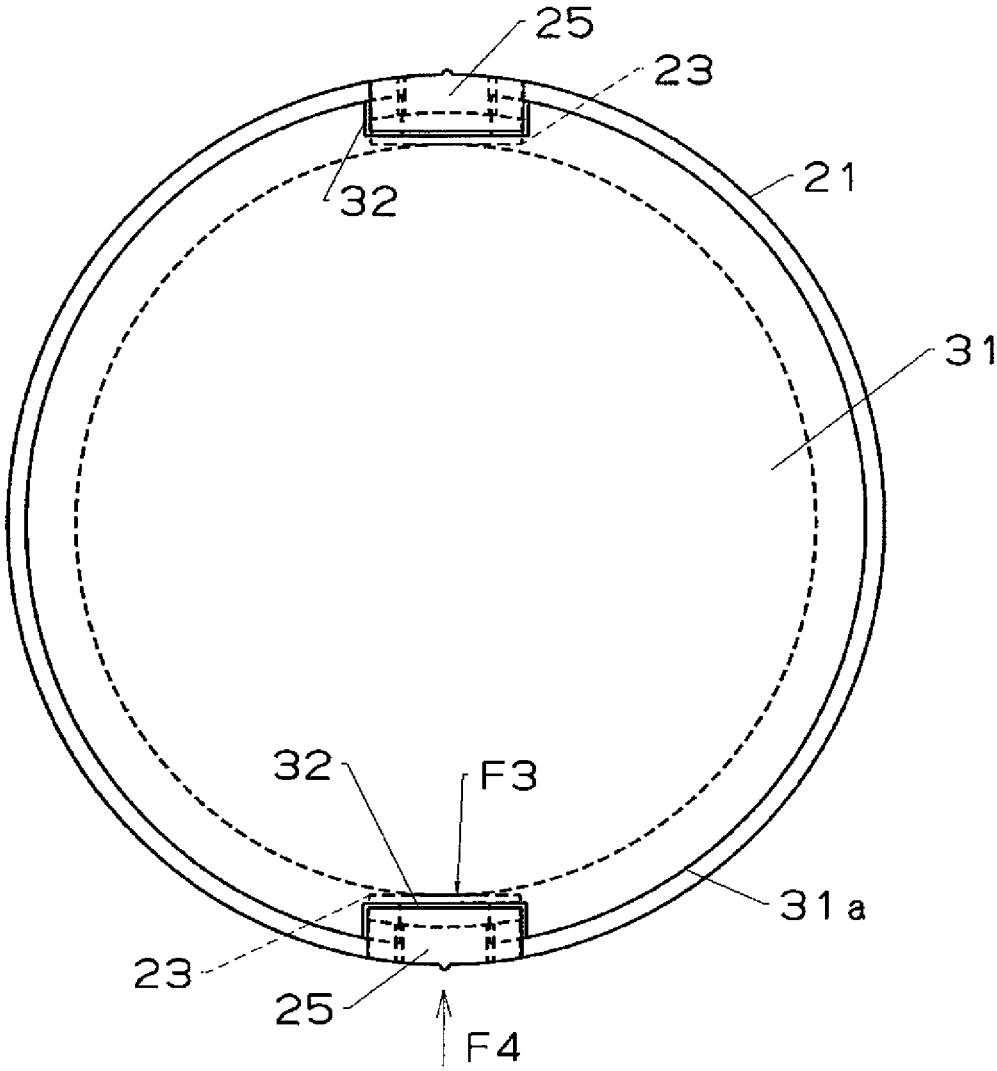
FIG. 2 is a schematic plan view that shows a relationship between a solar battery panel disposed on a movement included in the wristwatch of FIG. 1 and an hour plate.
Figure 3:
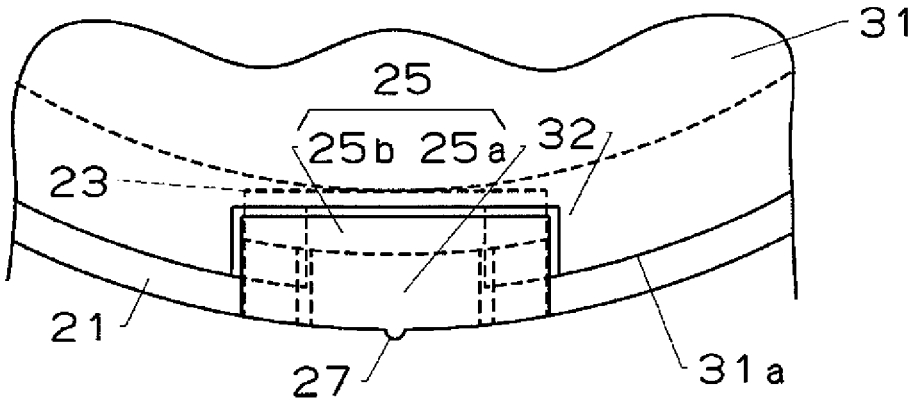
FIG. 3 is an enlarged plan view that shows a F3 portion in FIG. 2.
Figure 4:
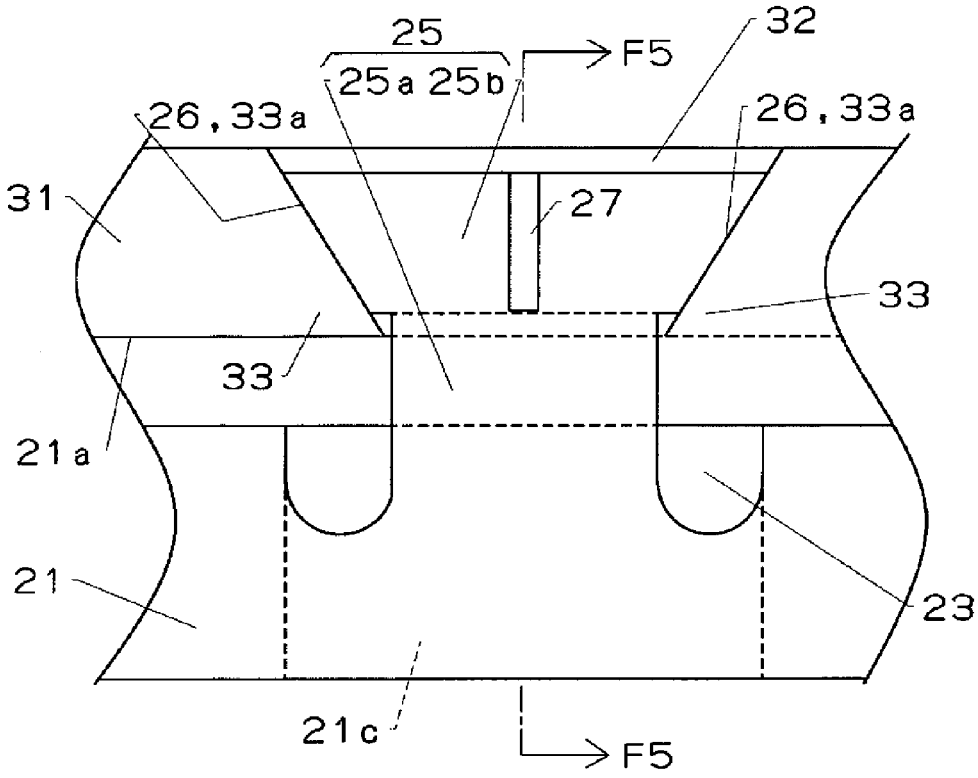
FIG. 4 is a side view of a F3 portion viewed from an arrow F4 line direction in FIG. 2.
Figure 5:
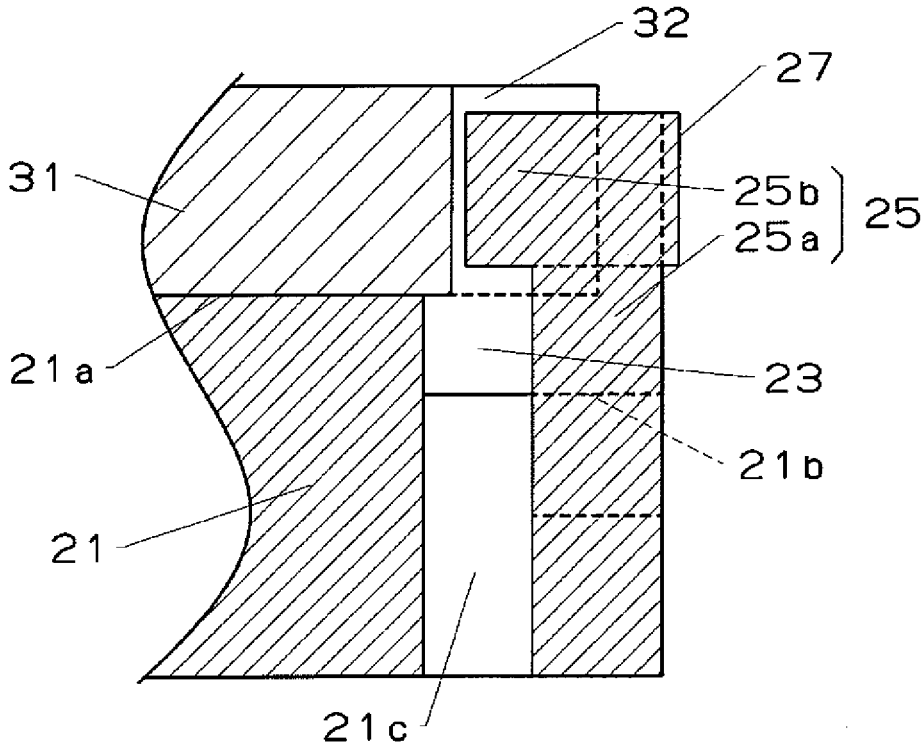
FIG. 5 is a cross-sectional view taken along line F5-F5 in FIG. 4.
Figure 6:
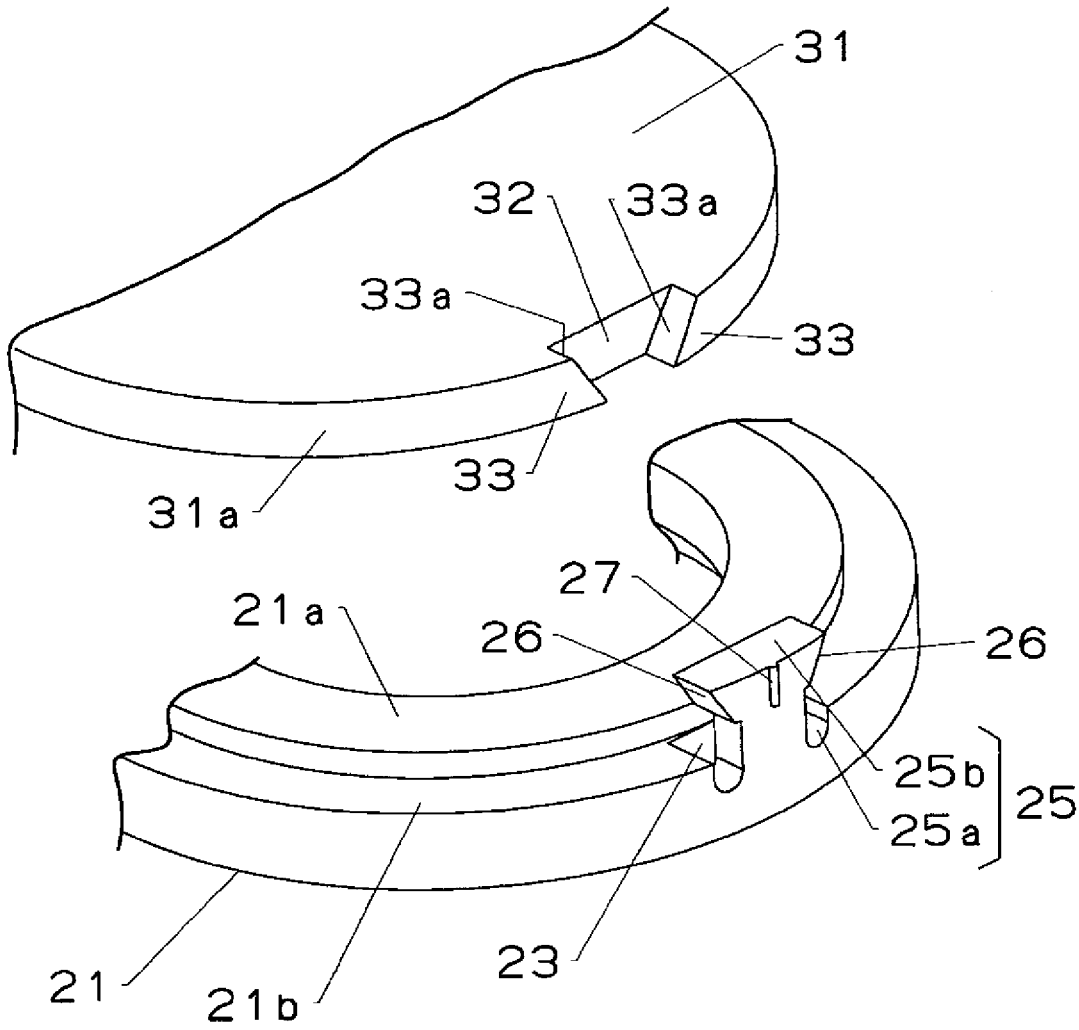
FIG. 6 is a plan view that shows each part of the ring member and the hour plate included in the wristwatch of FIG. 1 in a separated state.

As shown in FIG. 2, the hollows 23 are provided in two locations of the outer peripheral portion of the ring member 21, for example, so as to be separated by 180°. Furthermore, the hollows 23 may be provided in three locations for each 120°, or may be provided in four locations for each 90°. As shown in FIGS. 4 to 6, the respective hollows 23 are opened from the upper surface of the shoulder portion 21*b* to the upper surface 21*a* of the ring member 21 and the outer peripheral surface of the ring member 21, respectively.

The engagement convex portion 25 is surrounded by the hollow 23 in a base portion 25*a* thereof and is protruded upward. For that reason, most of the root portion 25*a* of the engagement convex portion 25 is situated at the lower side from the upper surface of the shoulder portion 21*b* lower than the upper surface 21*a* of the ring member 21, and the height of the root portion 25*a* is selected depending on the depth of the hollow 23. The engagement convex portion 25 can be elastically deformed in a radial direction of the ring member 21 and the hour plate 33 based on the lower end of the root portion 25*a*, that is, the root.

Furthermore, as shown in FIG. 4 or the like, the hollow 23 is also opened to the outer peripheral surface of the ring member 21 at both sides of the root portion 25*a* of the engagement convex portion 25. When removing the hour plate 31 described later from the ring member 21, a pair of opened hollow parts can be used as a part, into which a tool, such as a pincer, to be inserted to the back side of the hour plate 31, is inserted.

The engagement convex portion 25 has a pressing portion 25*b*. The pressing portion 25*b* is integrally and continuously provided upside the root portion 25*a*, and forms an upper portion of the engagement convex portion 25. A height of the upper end surface of the pressing portion 25*b* is higher than that of the upper surface 21*a* of the ring member 21. Furthermore, a thickness of the pressing portion 25*b* along the radial direction of the ring member 21 is formed to be thicker than those of other portions of the engagement convex portion 25 except for the pressing portion 25*a* (see FIG. 5). Furthermore, reference numeral 21*c* in FIGS. 4 and 6 indicates a die cutting hole for molding the pressing portion 25*b* integrally with the ring member 21.

As shown in FIGS. 4 and 6, the pressing portion 25*b* has pressing slope surfaces 26 at both sides in the width direction thereof. The pressing slope surfaces 26 are tilted or sloped so as to gradually widen the distance between them, that is, the width of the pressing portion 25*b* gradually increases in the upward direction.

As shown in FIGS. 3 to 6, a contact projection 27 protruded from the outer peripheral surface of the ring member 21 is integrally formed in the upper portion of the engagement convex portion 25. The contact projection 27 is, for example, formed by a bead that is vertically extended, but may be formed by a simple projection or a bead that is extended in the circumferential direction of the ring member 21.

As shown in FIG. 1, the ring member 21 is attached to the movement 11 so that a hook portion 28 is hooked to a lower surface 13 of the annular convex portion of the movement 11, and the engagement groove 22 is engaged with the upper surface of the engagement portion 12. By the attachment mentioned above, the hollow 23 and the engagement convex portion 25 separated by 180° are located in a direction of 12 o'clock-6 o'clock as described in FIG. 2, and the upper surface 21*a* of the ring member 21 except for the respective engagement convex portions 25 is situated so as to be slightly higher than the upper surface of the solar battery panel 15 (see FIG. 1). In addition, the placement of the pair of engagement convex portions 25 is not limited to the direction of 12 o'clock-6 o'clock like the hollow 23, but it is also possible to place the pair of engagement convex portions 25 in a direction of 9 o'clock-3 o'clock or other directions.

The hour plate 31 is molded in a thin plate shape by a translucent synthetic resin such as a transparent acrylic resin or a polycarbonate resin and can be elastically deformed. The hour plate 31 has an approximately circular shape and has a diameter that is slightly smaller than an outer diameter of the ring member 21. As shown in FIGS. 4 and 5, the thickness of the hour plate 31 is thicker than a height size of the pressing portion 25*b* along the vertical direction of the ring member 21. In the hour plate 31, displays such as graduations, numbers, and patterns not shown are provided.

Figure 7:
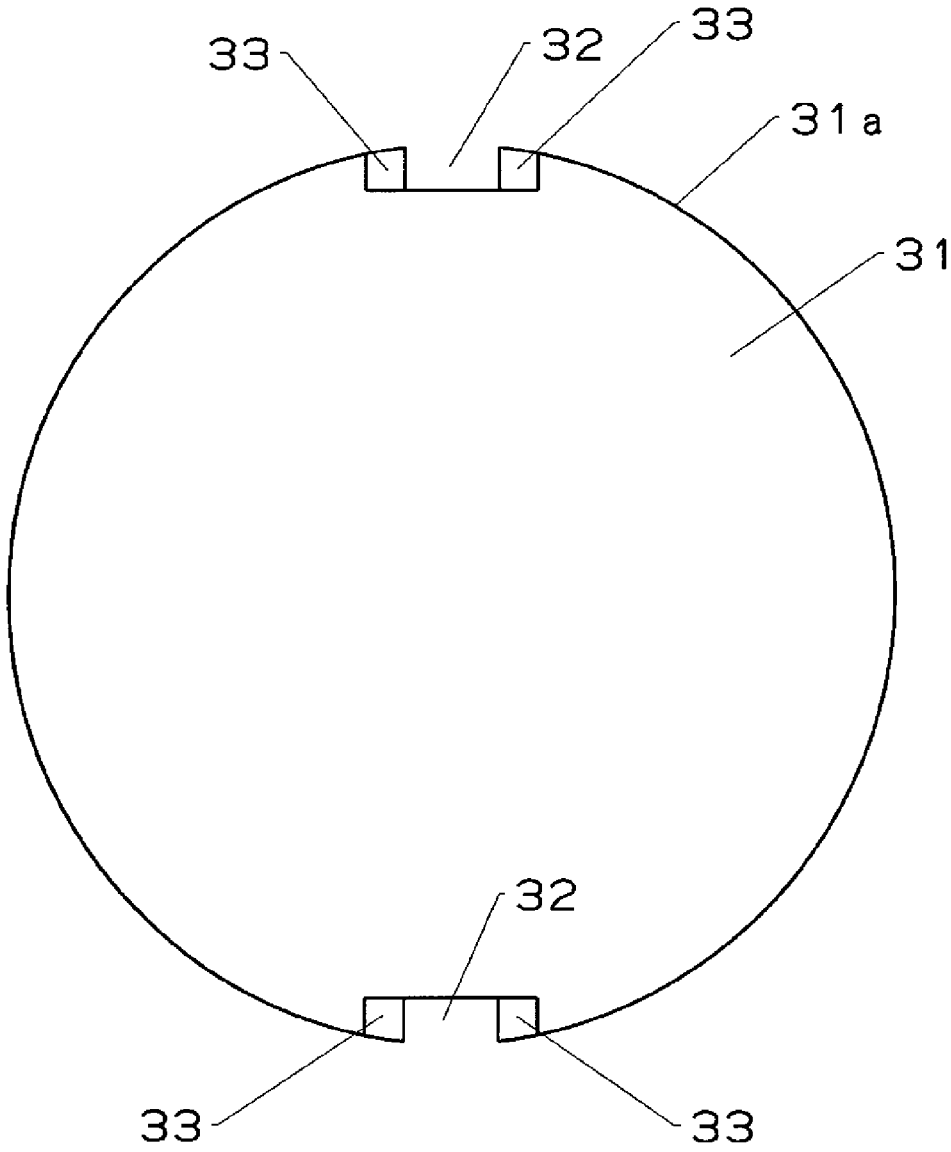
FIG. 7 is a schematic plan view that shows the hour plate included in the wristwatch of FIG. 1.
Figure 8:
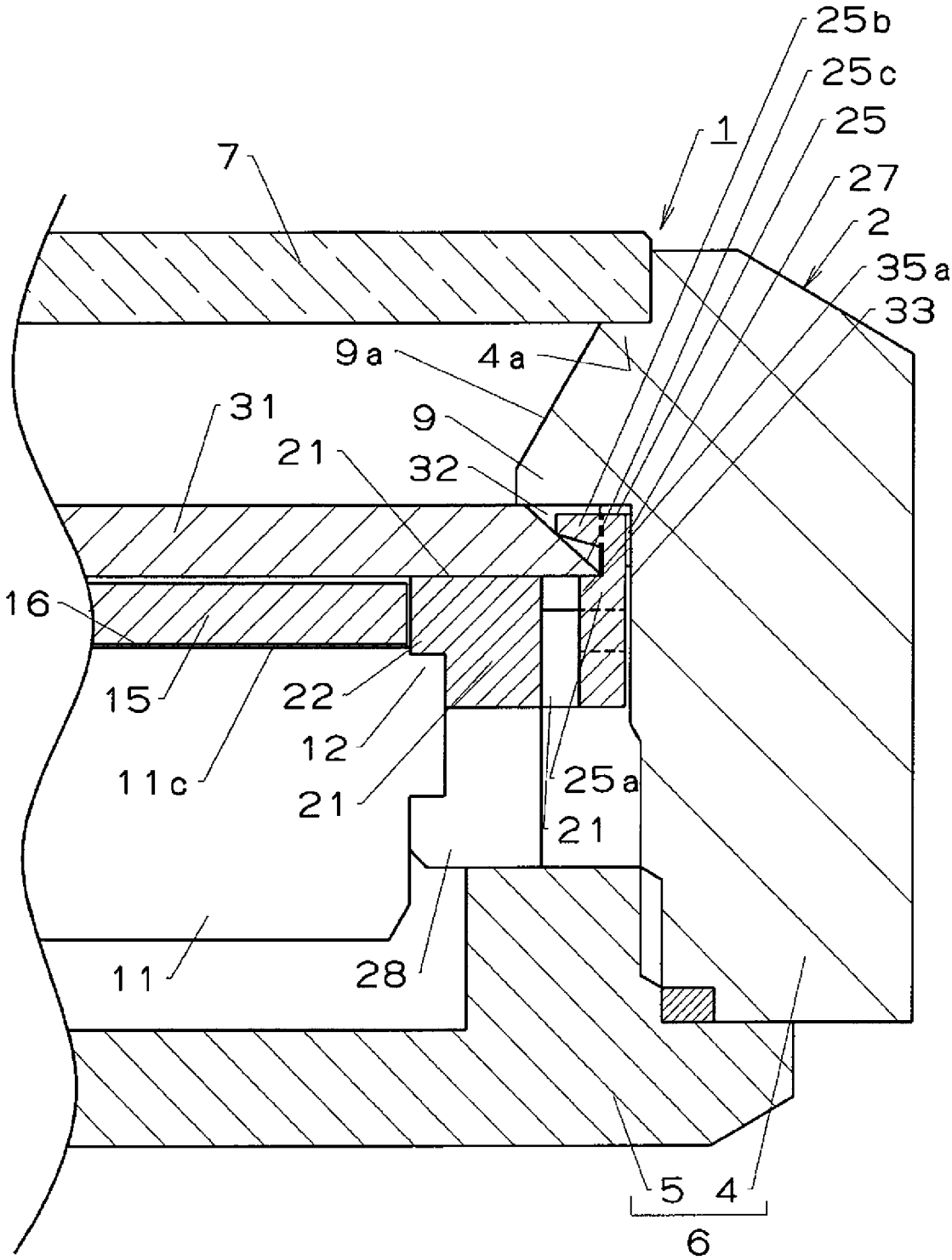
FIG. 8 is a cross-sectional view that shows a part of the wristwatch according to a second embodiment of the present invention.

As shown in FIGS. 6, 7 or the like, the hour plate 31 has a plurality of pressing portion accommodation grooves 32 and reception portions 33 in the peripheral side edge portion thereof. The respective pressing portion accommodation grooves 32 are formed so as to notch the hour plate 31 from the peripheral surface and are opened to the peripheral surface 31*a* of the hour plate 31. The respective pressing portion accommodation grooves 32 have the same number as that of the engagement convex portion 25, and are provided to comply with the placement of the engagement convex portion 25. Thus, as shown in FIG. 7, two pressing portion accommodation grooves 32 are provided so as to be separated by 180? in the circumferential direction of the hour plate 31.

The reception portion 33 of the hour plate 31 has a reception slope surface 33*a* that partitions a part of the pressing portion accommodation groove 32. As shown in FIG. 6, the pressing portion accommodation groove 32 is formed so as to be gradually widened as the reception slope surface 33*a* faces in the width direction thereof and slopes so as to face upward.

The hour plate 31 is attached to the ring member 21 so as to cover the solar battery panel 15. The attachment can be performed by pressing the hour plate 31 downward from the upper part of the ring member 21 in the state of positioning the engagement convex portion 25 and the pressing portion accommodation groove 32 of the hour plate 31 with respect to the ring member 21 that is mounted on the movement 11, and fitting the pressing portion accommodation groove 32 to the pressing portion 25*b* of the engagement convex portion 25. Otherwise, the attachment can be performed by tilting the hour plate 31, fitting one pressing portion accommodation portion 32 of the hour plate 31 to the pressing portion 25*b* of one engagement convex portion 25, then deflecting the hour plate 31, tilting the hour plate 31 to the other engagement convex portion 25, and fitting the other pressing portion accommodation groove 32 of the hour plate 31 to the pressing portion 25*b* of the other engagement convex portion 25.

When the hour plate 31 is attached to the ring member 21, the engagement convex portion 25 can be elastically deformed based on the root of the engagement convex portion 25 in a direction in which the pressing portion 25*b* deviates from the pressing portion accommodation groove 32. As a result, a work of placing the pressing portion accommodation groove 32 in a position where the reception portion 33 is pressed by the pressing portion 25*b* from above becomes easier, and it is possible to further improve the attachment workability of the hour plate 31.

Furthermore, since the root portion 25*a* of the engagement convex portion 25 is surrounded by the hollow 23, the length of the engagement convex portion 25 is ensured, and the elastic deformation thereof is easier. For this reason, it is possible to suppress the generation of a crack in the root due to the elastic deformation of the engagement convex portion 25.

In the state in which the attachment of the hour plate 31 onto the ring member 21 is completed, as shown in FIG. 5, most of the pressing portion 25*b* is housed in the pressing portion accommodation groove 32. In this manner, the pressing portions 25*b* of the engagement convex portions 25 are housed in the respective pressing portion accommodation grooves 32 formed in the peripheral portion of the hour plate 31, respectively, whereby it is possible to position the hour plate 31 in the circumferential direction of the ring member 21.

Along with this, as shown in FIG. 4, the lower surface of the reception portion 33 of the hour plate 31 attached to the ring member 21 comes into contact with the upper surface 21*a* of the ring member 21, and the reception slope surfaces 33*a* of the reception portion 33 come into contact with the pressing slope surfaces 26 of the pressing portion 25*b* from above, respectively.

That is, in the state in which the pressing portion 25*b* of the engagement convex portion 25 having the pair of pressing slope surfaces 26 coming into contact with the reception slope surface 33*a* enters between the pair of reception portions 33 having the reception slope surfaces 33*a* facing the width direction of the pressing portion accommodation groove 32 in a wedge shape from above, the pair of reception portions 33 are vertically interposed between the pressing portion 25*b* of the engagement convex portion 25 and the upper surface 21*a* of the ring member 21. In other words, in the state in which the pair of reception portions 33 formed in a tapered shape enter between the pressing portion 25*b* and the upper surface 21*a* of the ring member 21 in a wedge shape from a transverse direction so as to interpose the engagement convex portion 25 therebetween in the width direction thereof, the pair of reception portions 33 are vertically interposed between the pressing portion 25*b* of the engagement convex portion 25 and the upper surface 21*a* of the ring member 21. Furthermore, the upper end of the pressing member 25*b* comes down from the upper surface (the surface) of the hour plate 31.

As mentioned above, since the reception portions 33 are vertically interposed between the pressing portion 25 entered between the pair of reception portions 33 in the wedge shape and the upper surface 21*a* of the ring member 21, the hour plate 31 can be held so as not to be vertically moved. In addition to this, it is possible to hold the hour plate 31 so as not to be moved in the circumferential direction by using the pressing portion 25*b* of the engagement convex portion 25 as a stopper.

Moreover, since the engagement convex portion 25 and the reception portion 33 take charge of the floating stop and the rotation stop of the hour plate 31, the configuration is simple compared to a configuration in which the portions are separately provided.

Furthermore, it is possible to suppress the hour plate 31 moving to the upper side, floating or deviating with respect to the ring member 21, caused by the vibration applied to the ring member 21 mounted with the hour plate 31 until the ring member 21 is incorporated into the timepiece exterior assembly 2, by the pressing portion 25*a* of the engagement convex portion 25 with the peripheral portion of the hour plate 31 vertically interposed between the pressing portion 25*a* and the upper surface 21*a* of the ring member 21. In addition, even if the hour plate 31 attached to the ring member 21 tries to be moved in a radial direction connecting the pressing portion accommodation groove 32, the movement can be suppressed by using the engagement convex portion 25 as a stopper.

As mentioned above, since the pressing portion 25*b* of the engagement convex portion 25 is brought into contact with the reception portion 33 of the hour plate 31 from above to perform the floating stop of the hour plate 31 to the ring member 21, an excessive stress is hardly generated around the pressing portion accommodation groove 32 by the engagement convex portion 25. Accordingly, it is possible to suppress the hour plate 31 being attached to the ring member 21 in the state of being distorted so as to undulate starting from the pressing portion accommodation groove 32. Thus, it is possible to avoid the disadvantage when the hour plate 31 enters an undulated state. That is, the hour plate 31 can be attached so as to avoid a disadvantage that the reflection of light differs from each other in each portion of the hour plate 31, the undulated state of the hour plate 31 is easily visible, and an appearance of the timepiece 1 is impaired.

Furthermore, the assembly including the movement 11, the solar battery panel 15 bonded thereto, the ring member 21 attached to the movement 11, the hour plate 31 attached to the ring member 21 or the like is incorporated into the body 4 to which the back cover 5 is not attached through an opening closed by the back cover 5. In this case, as shown in FIG. 1, since the contact projection 27 protruded to the engagement convex portion 25 comes into contact with the inner peripheral surface of the body 4, the assembly is lightly pressed and is incorporated into the body 4.

In the assembly mentioned above, since the upper end of the pressing portion 26*b* of the engagement convex portion 25 is situated to be lower than the upper surface so as not to be protruded from the peripheral portion upper surface of the hour plate 31, the peripheral portion upper surface of the hour plate 31 comes into contact with the lower surface of the clearance 9 by using the clearance 9 as per degree, whereby the integration of the assembly in the body 4 is completed. For that reason, a gap cause by the pressing portion 25*b* is not formed between the clearance 9 and the peripheral portion upper surface of the hour plate 31 covered with the same from above. Thus, it is possible to suppress degrading of the appearance of the wristwatch 1.

Furthermore, by the integration of the assembly, the contact projection 27 protruded to the engagement convex portion 25 mentioned above comes into close contact with the inner peripheral surface of the body 4, and the pressing portion 25*b* of the engagement convex portion 25 is pushed toward the inner side of the pressing portion accommodation groove 32. As a result, the contact between the deformable pressing portion 25*b* and the reception portion 33 of the hour plate 31 is strengthened, and it is possible to hold the assembly in the radial direction of the timepiece exterior assembly 2 so as not to rattle.

The hour plate 31 attached in this manner faces the back surface of the cover glass 7 as shown in FIG. 1. Since the hour plate 31 has translucency, natural light or artificial light transmitted through the cover glass 7 and the hour plate 31 is incident to the solar battery panel 15, and along with this, the solar cell of the solar battery panel 15 is subjected to the photoelectric conversion to generate electricity. Thus, the wristwatch 1 accumulates the electric power generated in this manner in a secondary battery or a capacitor, and can drive the movement 11 by the electric power.

FIGS. 8 to 14 show a second embodiment of the present invention. A wristwatch according to the second embodiment is the same as that of the first embodiment except for a configuration described below. For that reason, the same configurations as those of the first embodiment are denoted by the same reference numerals as the first embodiment, and the descriptions thereof will be omitted.

Figure 10:
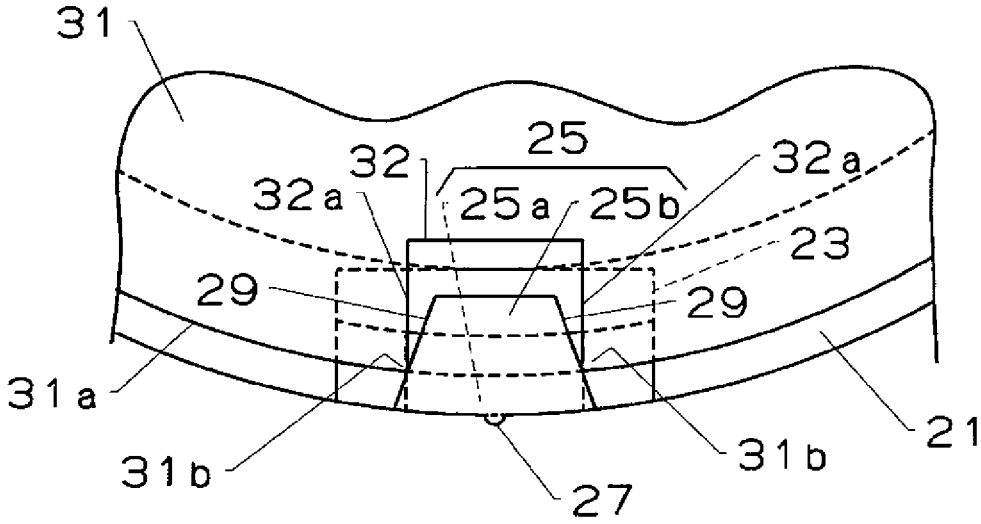
FIG. 10 is an enlarged plan view of a F10 portion in FIG. 9.
Figure 11:
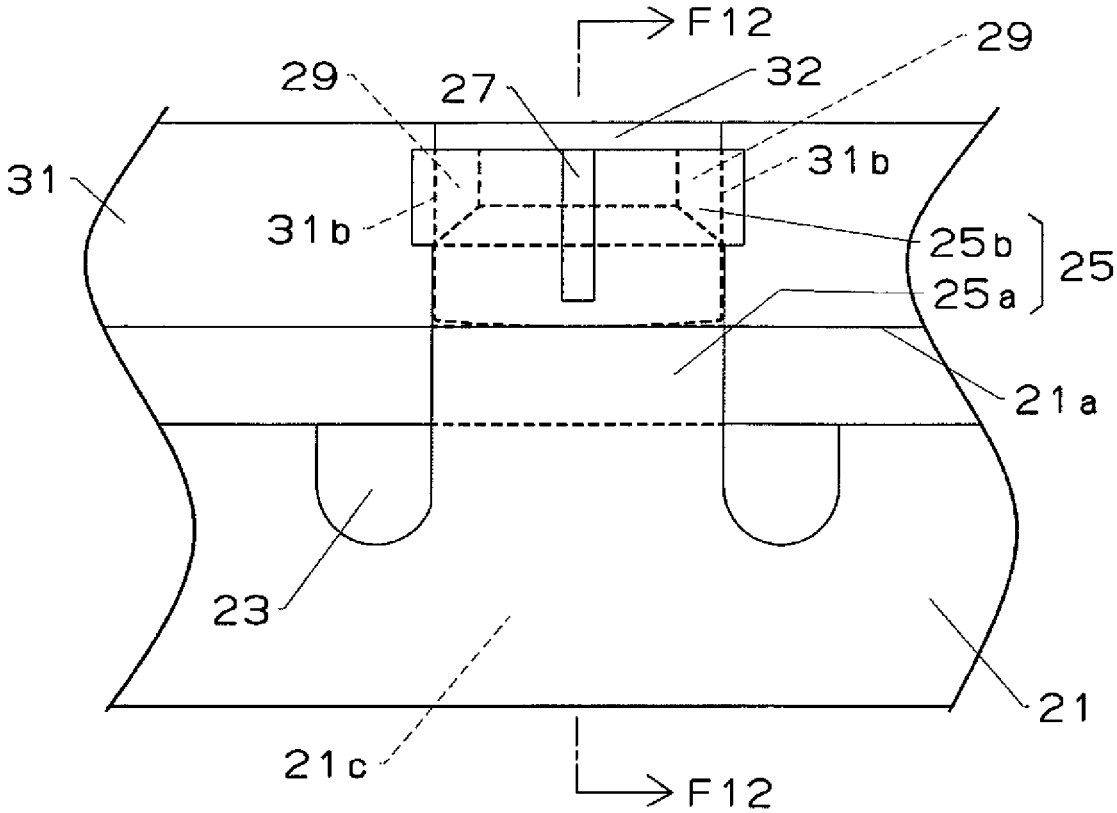
FIG. 11 is a side view of a F13 portion viewed from an arrow F11 line direction in FIG. 9.
Figure 12:
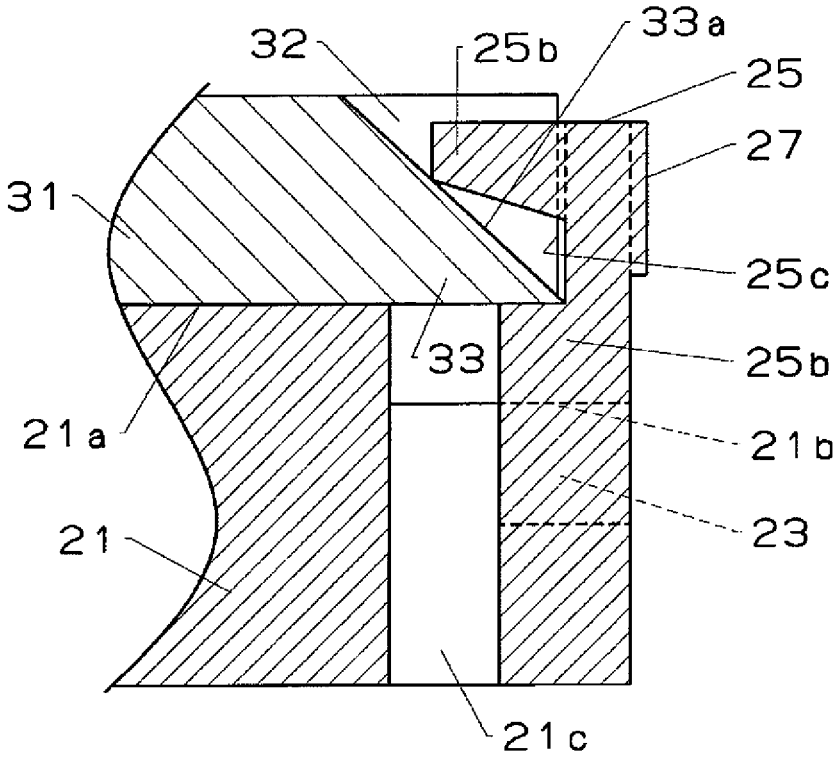
FIG. 12 is a cross-sectional view taken along line F12-F12 in FIG. 11.
Figure 13:
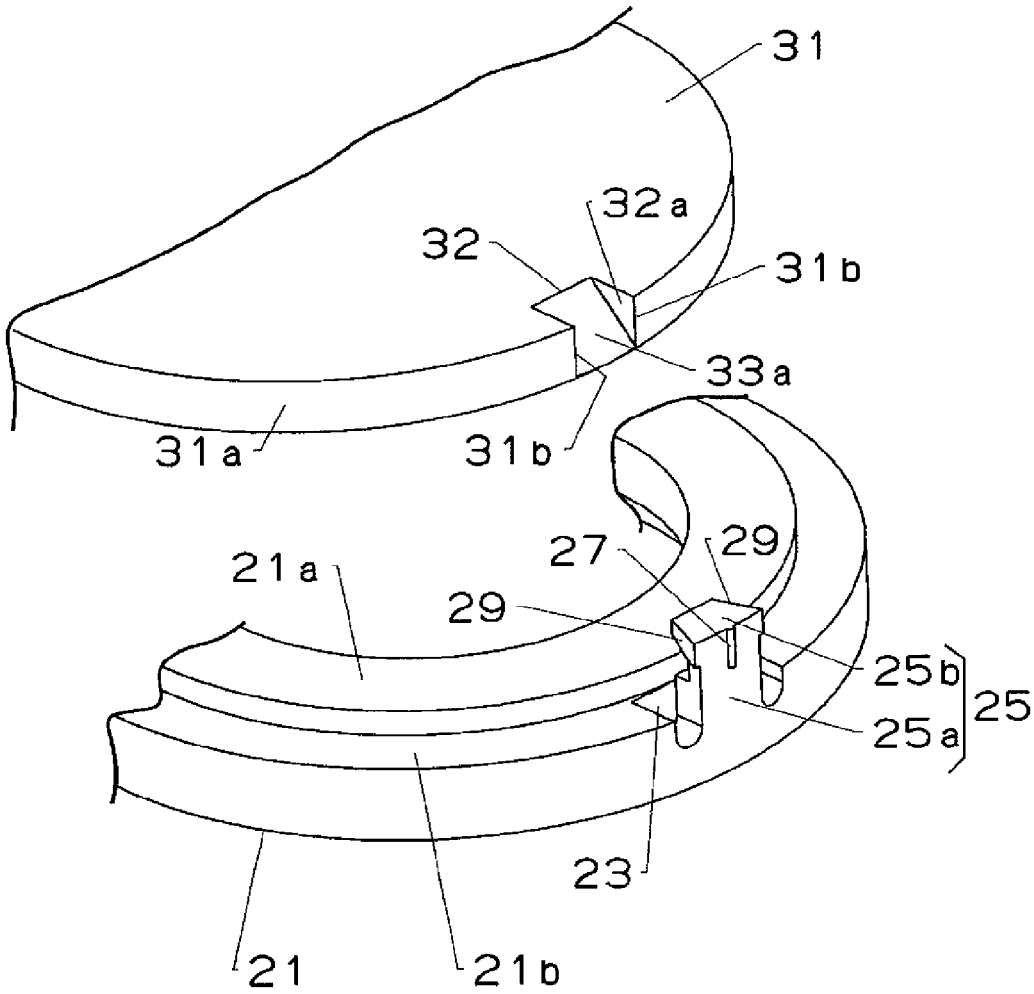
FIG. 13 is a plan view that shows each part of the ring member and the hour plate included in the wristwatch of FIG. 8 in a separated state.

In the second embodiment, as shown in FIGS. 10, 11 and 13, the pressing portion 25*b* of the engagement convex portion 25 has a slope side surfaces 29 sloped so as to be close to the tip side each other, and is formed in a tapered shape. That is, the suppression portion 25 has a narrowed tip side width. Furthermore, as shown in FIGS. 12 and 13, the engagement convex portion 25 has a groove portion 25*c* that is continuously formed at the underside of the pressing portion 25*b*.

Figure 9:
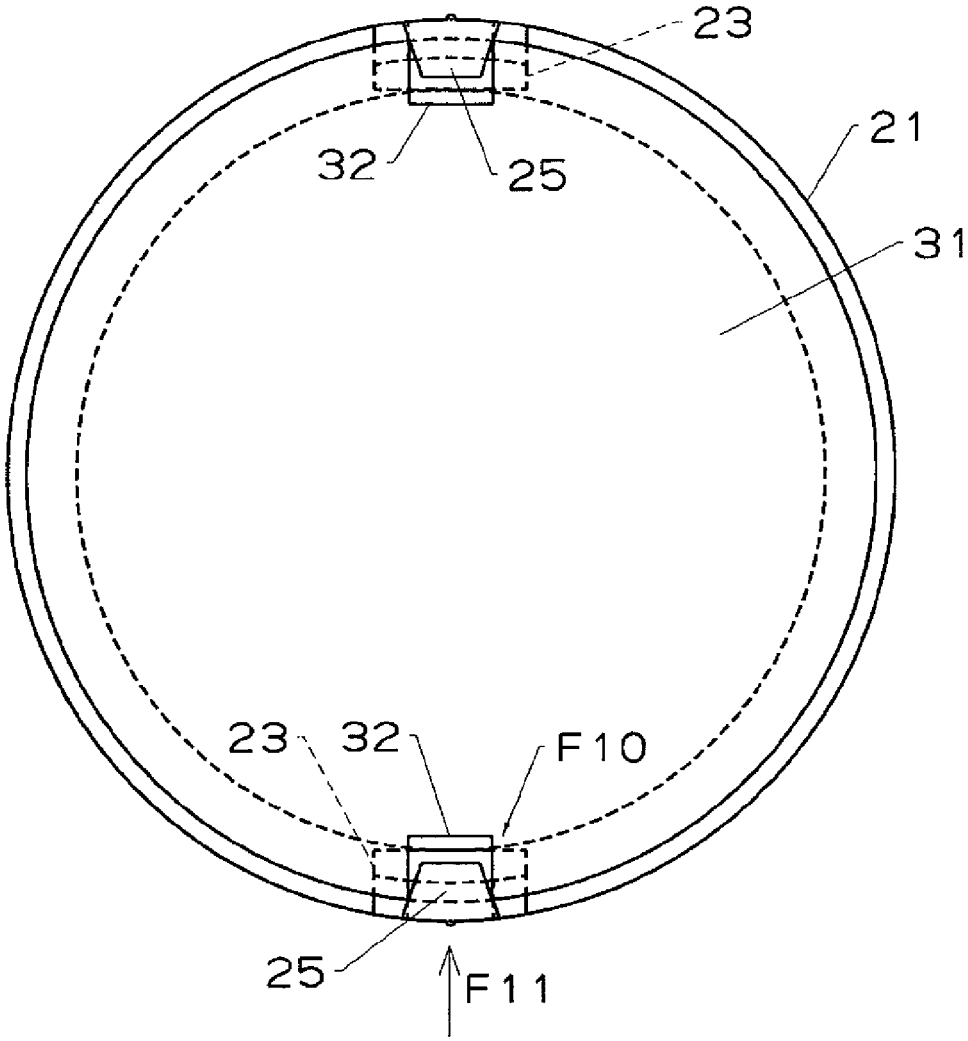
FIG. 9 is a schematic plan view that shows a relationship between a solar battery panel and an hour plate disposed on a movement included in the wristwatch of FIG. 8.
Figure 14:
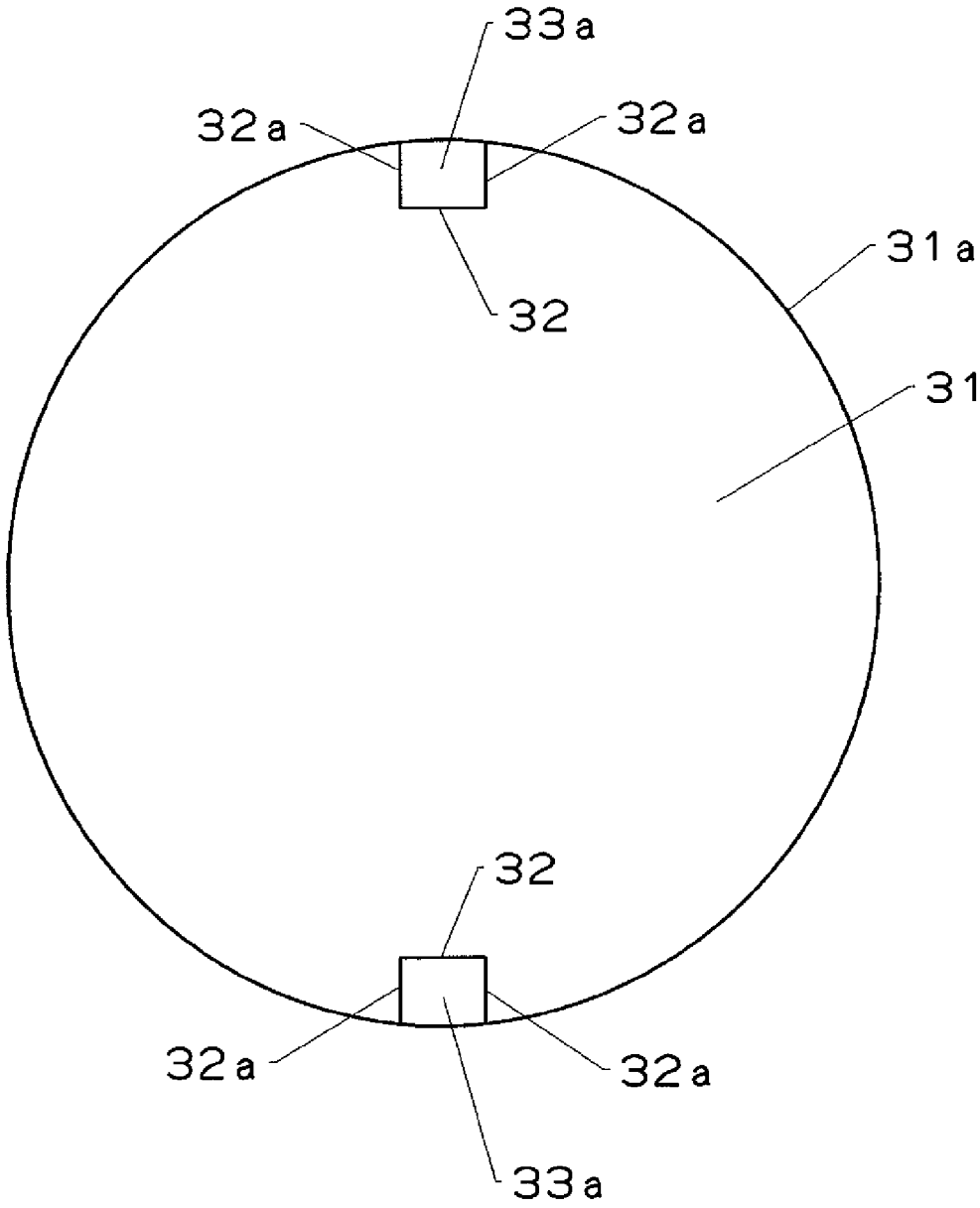
FIG. 14 is a schematic plan view that shows the hour plate included in the wristwatch of FIG. 8.

As shown in FIG. 9, the pressing portion accommodation grooves 32 provided at a plurality of locations of the hour plate 31, for example, in a position separated by 180° in the circumferential direction face each other as shown in FIGS. 13 and 14, preferably, the pressing portion accommodation grooves 32 are partitioned by the parallel groove side surface 32*a* and the reception slope surface 33*a* forming the bottom surface of the pressing portion accommodation groove 32, and are opened over the upper surface and the peripheral surface of the hour plate 31. The reception portion 33 has the reception slope surface 33*a*, and the reception slope surface 33*a* comes down and is tilted as facing the opening end of the pressing portion accommodation groove 32.

As shown in FIGS. 7 and 12, the tip portion of the pressing portion 25*b* housed in the pressing portion accommodation groove 32 comes into contact with the bottom surface of the pressing portion accommodation groove 32, that is, the reception slope surface 33*a* of the reception portion 33 from above. As a result, since the reception portion 33 is vertically interposed between the pressing portion 25*b* and the upper surface 21*a* of the ring member 21, it is possible to hold the hour plate 31 so as not to be vertically moved. Along with this, a thin end portion of the reception portion 33 pressed from above enters the groove portion 25*c* of the engagement convex portion 25, and is supported by the root portion 25*a* of the engagement convex portion 25 from below.

Furthermore, as shown in FIG. 10, the slope side surfaces 29 of the pressing portion 25*b* comes into close contact with the corners 31*b* formed by the groove side surface 32*a* and the peripheral surface of the hour plate 31, respectively. As a result, it is possible to hold the hour plate 31 so as not to be moved in the circumferential direction by using the pressing portion 25*b* of the engagement convex portion 25 as a stopper.

Thus, in the second embodiment, since the engagement convex portion 25 and the reception portion 33 can also take charge of the floating stop and the rotation stop of the hour plate 31, the configuration is simple compared to a configuration in which the portions are separately provided.

Configurations and actions other than those described above are the same as those of the first embodiment. For that reason, in the second embodiment, by the same reason as described in the first embodiment in advance, the same action as the first embodiment is obtained, and the object of the present invention can be attained. That is, it is possible to provide a wristwatch 1 which can suppress the distorted attachment of the display plate 33 and can suppress that the hour plate 31 floats or deviates to the ring member until the display plate 31 attached to the ring member 21 is incorporated into the timepiece exterior assembly 2.

In addition, the present invention is not limited to the respective embodiments mentioned above. For example, it is possible to use a light emitting panel instead of the solar battery panel in the respective embodiments mentioned above. In the light emitting panel, for example, a panel constituted by an electroluminescence element can suitably be used, and the light emitting panel emits light by the electric power that is supplied from a secondary battery or the like equipped in a timepiece exterior assembly. In this case, the light emitting panel emits light by the electric conduction thereto, the backlight illumination to the display plate is generated by the light emitting panel, and thus, the visibility of the display of the time or the like can be further improved. Furthermore, the present invention can also be applied to a pocket watch or the like besides the wristwatch.

What is claimed is:

1. A timepiece comprising:

a timepiece exterior assembly;

a module disposed in the timepiece exterior assembly;

a panel fixed to the module;

a ring member fixed to a peripheral portion of the module and having upward engagement convex portions provided thereon at a plurality of locations, the engagement convex portions having pressing portions; and a display plate disposed to cover the panel and having a plurality of reception portions in a peripheral portion thereof with which the pressing portions come in contact from above, the reception portions being vertically interposed by an upper surface of the ring member and the pressing portions and being attached to the ring member.

2. The timepiece according to claim 1, wherein pressing portion accommodation grooves opened to the peripheral surface of the display plate are formed in a plurality of locations of the peripheral portion of the display plate, the reception portions are provided so as to partition a part of the pressing portion accommodation grooves, and the pressing portions are housed in the pressing portion accommodation grooves.

3. The timepiece according to claim 2, wherein the reception portions have reception slope surfaces that partition a part of the pressing portion accommodation grooves, the reception slope surfaces face a width direction of the pressing portion accommodation grooves and are widely formed as the pressing portion accommodation grooves face upward, and the pressing portions have pressing slope surfaces coming into contact with the reception slope surfaces from above, respectively, and are widely formed as the pressing portions face upward.

4. The timepiece according to claim 2, further comprising mutually opposite groove side surfaces of the pressing portion accommodation grooves, wherein the reception portions have reception slope surfaces that partition a part of the pressing portion accommodation grooves, the reception slope surfaces are formed on bottom surfaces of the pressing portion accommodation grooves sloped down as the reception slope surfaces face open ends of the pressing portion accommodation grooves, the pressing portions have slope side surfaces sloped so as to approach each other as going to tip sides thereof and are formed in a tapered shape, the tip portions of the pressing portions come into contact with the reception slope surfaces from above, and the slope side surfaces come into contact with corners formed by the groove side surfaces and the peripheral surface of the display plate, respectively.

5. The timepiece according to claim 1, wherein each engagement convex portion is able to be elastically deformed in a radial direction of the ring member and the display plate based on a root thereof.

6. The timepiece according to claim 5, wherein a contact projection coming into contact with an inner peripheral surface of a body included in the timepiece exterior assembly is integrally provided in an upper portion of each engagement convex portion.

7. The timepiece according to claim 2, further comprising an annular clearance which comes into contact with an upper surface of the peripheral portion of the display plate and covers the peripheral portion, and a wherein height of the upper end of the pressing portion is equal to or less than the upper surface of the display plate.

8. The timepiece according to claim 1, wherein the panel is a solar battery panel that generates electricity by a photoelectric conversion.

9. The timepiece according to claim 1, wherein the panel is a light emitting panel that emits light in an electrically conducted state.

* * * * *